US006144150A

United States Patent [19]

Ueda et al.

[11] Patent Number: 6,144,150

[45] Date of Patent: Nov. 7, 2000

[54] COLOR PICTURE TUBE APPARATUS

[75] Inventors: Yasuyuki Ueda; Kazunori Ohta, both of Osaka, Japan

[73] Assignee: Matsushita Electronics Corporation, Osaka, Japan

[21] Appl. No.: 09/049,239

[22] Filed: Mar. 27, 1998

[30] Foreign Application Priority Data

Apr. 4, 1997 [JP] Japan ..... 9-086403

[51] Int. Cl.[7] ..... H01J 29/48

[52] U.S. Cl. ..... 313/414; 313/412; 313/428; 313/432; 313/439

[58] Field of Search ..... 313/412, 414, 313/428, 432, 439, 429, 458, 460

[56] References Cited

U.S. PATENT DOCUMENTS

| | | | |
|---|---|---|---|
| 3,496,406 | 2/1970 | Deschamps | 313/429 |
| 4,623,819 | 11/1986 | Janko et al. | 313/432 |
| 4,814,670 | 3/1989 | Suzuki et al. . | |
| 5,164,640 | 11/1992 | Son et al. | 313/414 |
| 5,608,284 | 3/1997 | Tojyou et al. | 313/414 |
| 5,864,203 | 1/1999 | Yamane | 313/414 |

FOREIGN PATENT DOCUMENTS 61-99249 5/1986 Japan .

*Primary Examiner*—Ashok Patel
*Attorney, Agent, or Firm*—Merchant & Gould P.C.

[57] ABSTRACT

A color picture tube apparatus comprises auxiliary electrodes provided between first and second focusing electrodes, a nonaxisymmetric electrostatic lens is generated between the auxiliary electrodes and a focusing lens is generated between the first focusing electrode and the auxiliary electrode. A dynamic voltage $V_d$ is applied to the first and second focusing electrodes. Consequently, the effect of compensating the astigmatism of the electron beam caused by the deflection magnetic field and the defocus of the electron beam can be increased, the dynamic voltage can be decreased, and as a result, the cost of the circuit can be reduced. As the focusing function of the additional focusing lens is weakened and the electron beam trajectory is expanded, the magnification of the lens both at the center and the periphery of the screen can be equalized substantially and the uniformity of the focus of the electron beam between that at the center of the screen and that at the periphery of the screen becomes high.

16 Claims, 12 Drawing Sheets

COLOR PICTURE TUBE APPARATUS

FIELD OF THE INVENTION

The present invention relates to a color picture tube apparatus in which a high resolution picture can be displayed over the entire region of a phosphor screen surface.

BACKGROUND OF THE INVENTION

Conventionally, in-line self-convergence color picture tubes distort a horizontal deflection magnetic field as a pincushion shape and a vertical deflection magnetic field as a barrel shape. According to the conventional picture tube apparatus, astigmatism of the electron beam caused by the deflection magnetic field is generated and defocus of the electron beam is generated as the distance to the screen becomes long. Consequently, the beam spot can be focused in an optimum condition in the horizontal direction, however, the beam spot is over-focused in the vertical direction and the resolution in the vertical direction is deteriorated.

In order to solve the above-mentioned problem, one structure is disclosed in Japanese Laid Open Patent No. (Ibkkai-Sho) 61-99249. FIG. 10 is a perspective view showing a part of an electron gun of the color picture tube apparatus of the prior art. The electron gun shown in FIG. 10 comprises a cathode 5, a control lattice electrode 6, an accelerating electrode 7, a first focusing electrode 8, a second focusing electrode 9 and a final accelerating electrode 10.

Circular beam through holes are provided in the end surface of the control lattice electrode 6, in that of the accelerating electrode 7, and that of the first focusing electrode 8 facing the accelerating electrode 7. Further, circular beam through holes are provided in the end surface of the second focusing electrode 9 facing the final accelerating electrode 10 and that of the final accelerating electrode 10 facing the second focusing electrode 9.

A nonaxisymmetric electrostatic lens generating means is provided between the first focusing electrode 8 and the second focusing electrode 9. More concretely, electron beam through holes that are vertically oblong are provided at the end surface of the first focusing electrode 8 facing the second focusing electrode 9 and electron beam through holes that are horizontally oblong are provided at the end surface the second focusing electrode 9 facing the first focusing electrode 8.

A compound voltage, in which a dynamic voltage Vd is synchronized with the deflection of electron beam and superimposed on the focusing voltage $V_{g3}$, is applied to the second focusing electrode 9.

FIG. 11 shows an example of the lens model of the conventional color picture tube apparatus. The upper side of FIG. 11 shows the horizontal direction and the lower side of FIG. 11 shows the vertical direction. An electron beam trajectory 18 shows the electron beam trajectory at the center part of the screen and the periphery of the screen when the electron beam is deflected.

When an electron beam is deflected, a quadrupole lens 16 is generated by the nonaxisymmetric electrostatic lens generating means and the astigmatism of electron beam caused by the deflection magnetic field is compensated by the quadrupole lens 16. At the same time, a potential of the second focusing electrode 9 is increased and the difference between the potential of the second focusing electrode 9 and the accelerating potential Va of the final accelerating electrode 10 is decreased. As a result, the focusing function of the main lens 17 provided between the second focusing electrode 9 and the final accelerating electrode 10 is weakened and at the same time, the defocus of the electron beam can be compensated.

However, the above-mentioned color picture tube apparatus has the following problems.

(1) As shown in FIG. 12, the distance between the electron gun 3 and the periphery of the phosphor screen 2 is longer than that between the electron gun 3 and the center of the phosphor screen. As a result, Θp, the angle of incidence of electron beam at the periphery of the phosphor screen becomes smaller than Θc, that at the center of the phosphor screen. In general, the magnification of the lens is in inverse proportion to the angle of incidence at the screen, and therefore the diameter of the spot at the periphery of the screen becomes longer than that at the center of the screen. Consequently, when there is the difference of the diameter of the spot between the center and the periphery of the screen, the uniformity of the focus of electron beam between the center and the periphery of the screen is deteriorated.

(2) When the size of the color picture tube apparatus is enlarged, the dynamic voltage is increased. Consequently, if the size of the color picture tube apparatus is intended to be enlarged, the load of the circuit is increased, and as a result, the cost is increased.

(3) Two pins for applying the voltage are required, consequently the load of the circuit is increased, and as a result, the cost is increased.

SUMMARY OF THE INVENTION

In order to solve the above-mentioned problems, this invention provides a color picture tube apparatus that can equalize substantially the magnification of the lens at the center and that at the periphery of the screen and reduce the cost.

According to the present invention, there is provided a color picture tube apparatus comprising three cathodes that are in-line arranged in the horizontal direction, an accelerating electrode, a plurality of focusing electrodes, an auxiliary electrode provided between the plurality of focusing electrodes, a nonaxisymmetric electrostatic lens generated by an adjoining pair of electrodes, a focusing lens generated by an adjoining pair of electrodes, wherein a dynamic voltage is synchronized with the deflection of electron beam and applied to one of the electrodes that generates the focusing lens, and the dynamic voltage is induced at the other electrode at which the focusing lens is generated and the dynamic voltage is induced at one of the electrodes at which the nonaixsymmetric electrostatic lens is generated.

According to this color picture tube apparatus, the compensating effect of the astigmatism of the electron beam caused by the deflection magnetic field and defocus of electron beam are strengthened and the dynamic voltage is decreased, and as a result, the cost of the circuit is reduced. Further, the focusing function of the additional focusing lens can be weakened and the electron beam trajectory of the electron beam is expanded. Consequently, the magnification of the lens at the center of the screen and the periphery of the screen can be equalized substantially and the increase of the diameter of the spot at the periphery of the screen can be prevented.

It is preferable that the color picture tube apparatus comprises first and second focusing electrodes, the number of the auxiliary electrode is more than one, a plurality of auxiliary electrodes are provided between the first and second focusing electrodes, the nonaxisymmetric electrostatic lens generating means is provided between the plurality of auxiliary electrodes, and the focusing lens generating means is provided between the first focusing electrode and the auxiliary electrodes. One of the auxiliary electrodes is connected electrically with the accelerating electrode, the residual auxiliary electrodes are connected electrically with the accelerating electrode via resistance and a dynamic voltage, which is synchronized with the deflection of electron beam, is applied to the first and second focusing electrodes.

According to this color picture tube apparatus, the compensating effect of the astigmatism of the electron beam caused by the deflection magnetic field and defocus of electron beam are strengthened and the dynamic voltage is decreased, and as a result, the cost of the circuit is reduced. Further, the focusing function of the additional focusing lens can be weakened and the electron beam trajectory is extended. Consequently, the magnification of the lens at the center of the screen and the periphery of the screen can be equalized substantially and the increase of the diameter of the spot at the periphery of the screen can be prevented. Further, a potential at the second focusing electrode is increased and the difference between the potential at the second focusing electrode and that at the final accelerating electrode becomes small, and the focusing function of the main lens generated between the second focusing electrode and the final accelerating electrode is weakened. Consequently, the effect of compensating the defocus can be added.

It is preferable that the nonaxisymmetric electrostatic lens generating means is a quadrupole lens having a focusing function in the horizontal direction and a divergence function in the vertical direction.

According to this color picture tube apparatus, the astigmatism of the electron beam caused by the deflection magnetic field can be compensated.

It is preferable that the quadrupole lens is generated by the accelerating potential. According to the color picture tube apparatus, the lens function can be strengthened and the effect of compensating the astigmatism of the electron beam caused by the deflection magnetic field can be strengthened.

When R represents the value of the resistance, C represents the capacitance between the auxiliary electrodes by which the nonaxisymmetric electrostatic lens is generated, and f represents the deflection frequency, it is preferable that the relation $R>1/(2\pi fC)$ is satisfied.

According to this color picture tube apparatus, the dynamic voltage can be induced at the auxiliary electrode.

It is preferable that a compound voltage in which the dynamic voltage is superimposed on the focusing voltage is applied. According to this color picture tube apparatus, the potential of the second focusing electrode is increased and the potential difference between the second focusing electrode and the final accelerating electrode becomes small, and consequently the focusing function of the main lens generated between the second focusing electrode and the final accelerating electrode can be weakened.

It is preferable that the color picture tube apparatus comprise three auxiliary electrodes, the nonaxisymmetric electrostatic lens generating means is provided between the auxiliary electrode facing the second focusing electrode and the middle-positioned auxiliary electrode, and the focusing lens generating means is provided between the first focusing electrode and the auxiliary electrode facing the first focusing electrode. According to this color picture tube apparatus, a quadrupole lens and an additional focusing lens can be generated between the first and second focusing electrodes.

It is preferable that the nonaxisymmetric electrostatic lens generating means comprises the rectangular and vertically oblong electron beam through holes provided at the end surface of the middle-positioned auxiliary electrode facing the second focusing electrode and comprises the rectangular and horizontally oblong beam through holes provided at the end surface of the auxiliary electrode at the side of the second focusing electrode facing the middle-positioned auxiliary electrode. According to this color picture tube apparatus, a quadrupole lens having a focusing function in the horizontal direction and a divergence function in the vertical direction can be generated, and consequently the astigmatism of the electron beam caused by the deflection magnetic field can be compensated.

It is preferable that the color picture tube apparatus comprises two auxiliary electrodes, the nonaxisymmetric electrostatic lens generating means is provided between the two auxiliary electrodes and the focusing lens generating means is provided between the first focusing electrode and the auxiliary electrode facing the first focusing electrode. According to this color picture tube apparatus, the distance between the second focusing electrode and the auxiliary electrode can be widened. Consequently, the effective diameter of the electron lens generated between the electrodes can be increased, and the unnecessary aberration caused by the focusing of the electron beam at the portion is not added. As a result, the shape of the electron beam spot becomes preferable and the resolution of the image display can be increased.

It is preferable that the nonaxisymmetric electrostatic lens generating means comprises the rectangular and vertically oblong electron beam through holes provided at the end surface of the auxiliary electrode at the side of the first focusing electrode facing the second focusing electrode and comprises the rectangular and horizontally oblong electron beam through holes provided at the end surface of the auxiliary electrode at the side of the second focusing electrode facing the first focusing electrode. According to this color picture tube apparatus, a quadrupole lens having a focusing function in the horizontal direction and a divergence function in the vertical direction can be generated, and consequently the astigmatism of electron beam caused by the deflection magnetic field can be compensated.

The color picture tube apparatus comprises first, second, third and fourth focusing electrodes which are arranged in that order from the side of the cathodes in the direction of electron beam travel, the auxiliary electrode is provided between the first and second focusing electrodes, the nonaxisymmetric electrostatic lens generating means is provided at least one position between the second and third focusing electrodes and between the third and fourth focusing electrodes, and a focusing lens generating means is provided between the first and second focusing electrodes. The first, second and fourth focusing electrodes are connected electrically, the third focusing electrode is connected electrically with the fourth focusing electrode via resistance, an accelerating voltage is applied to the accelerating electrode, a focusing voltage is applied to the third focusing electrode and a compound voltage, in which a dynamic voltage which is synchronized with the deflection of electron beam and is superimposed on the accelerating voltage, is applied to the auxiliary electrode.

According to this color picture tube apparatus, a dynamic voltage is superimposed on an accelerating voltage which is a low voltage, the load of the circuit is decreased, and as a result, the cost of the circuit is reduced. Further, the electron beam trajectory is expanded by weakening the focusing function of the additional focusing lens. Consequently, the magnification of the lens at the center and the periphery of the screen can be equalized substantially and the increase of the diameter of the spot at the periphery of the screen can be prevented.

In the second color picture tube apparatus, it is preferable that the nonaxisymmetric electrostatic lens generating means is provided between the third and fourth focusing electrodes. It is also preferable that the nonaxisymmetric electrostatic lens generating means has a focusing function in the horizontal direction and a divergence function in the vertical direction.

According to this color picture tube apparatus, the astigmatism of the electron beam caused by the deflection magnetic field can be compensated.

It is preferable that the nonaxisymmetric electrostatic lens generating means comprise circular beam through holes provided at the third focusing electrode facing the second focusing electrode, rectangular and vertically oblong electron beam through holes provided at the end surface of the third focusing electrode facing the fourth focusing electrode and the rectangular and horizontally oblong electron beam through holes provided at the end surface of the fourth focusing electrode facing the third focusing electrode. According to this color picture tube apparatus, a quadrupole lens having a focusing function in the horizontal direction and a divergence function in the vertical direction can be generated, and consequently the astigmatism of the electron beam caused by the deflection magnetic field can be compensated.

It is preferable that the nonaxisymmetric electrostatic lens generating means is provided between the second and third focusing electrodes, and between the third and fourth focusing electrodes. It is preferable that the nonaxisymmetric electrostatic lens generated between the second and third focusing electrodes has a divergence function in the horizontal direction and a focusing function in the vertical direction. Further, it is preferable that the nonaxisymmetric electrostatic lens generated between the third and fourth focusing electrode has a focusing function in the horizontal direction and a divergence function in the vertical direction.

According to this color picture tube apparatus, an angle of incidence of electron beam at the screen both in the horizontal and vertical directions can be controlled. Consequently the shape of the spot at the periphery of the screen can be formed to be the same shape as that at the center part of the screen, that is a circle.

It is preferable that the nonaxisymmetric electrostatic lens generating means comprises the rectangular and vertically oblong electron beam through holes provided at the end surface of the second focusing electrode facing the third focusing electrode and that provided at the end surface of the third focusing electrode facing the fourth focusing electrode, and the rectangular and horizontally oblong electron beam through hole provided at the end surface of the third focusing electrode facing the second focusing electrode and provided at the end surface of the fourth focusing electrode facing the third focusing electrode. According to this color picture tube apparatus, two quadrupole lenses which have opposite functions in the horizontal and the vertical directions respectively can be generated.

When R represents the value of the resistance, C represents the capacitance between the electrodes by which the nonaxisymmetric electrostatic lens is generated, and f represents the deflection frequency, it is preferable that the relation $R>1/(2\pi fC)$ is satisfied.

According to this color picture tube apparatus, a dynamic voltage can be induced at the first and second focusing electrode provided at both sides of the auxiliary electrode.

DETAILED DESCRIPTION OF THE PREFERRED EMBODIMENT

Hereinafter, an example of a color picture tube apparatus of this invention will be explained referring to the figures.

Figure 1:
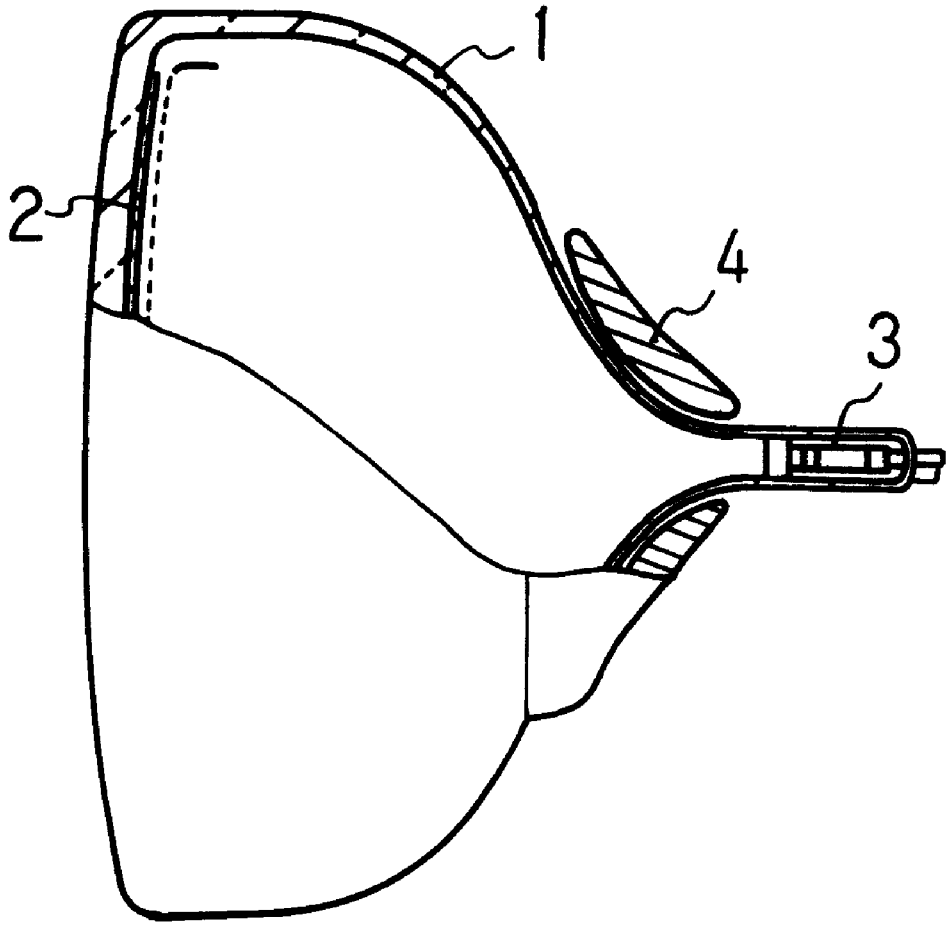
FIG. 1 is a partially sectional view showing the color picture tube apparatus of this invention.

FIG. 1 is a partially sectional view showing the color picture tube apparatus of this invention. As shown in FIG. 1, the color picture tube apparatus comprises an envelope 1 including a panel and funnel, and a phosphor screen surface 2 provided inside of the panel. An electron gun 3 is provided inside of the neck portion of the envelope 1, and a deflection yoke 4 is provided at the periphery of the envelope 1 in the vicinity of the neck portion at the side of the panel.

(first embodiment)

Figure 2:
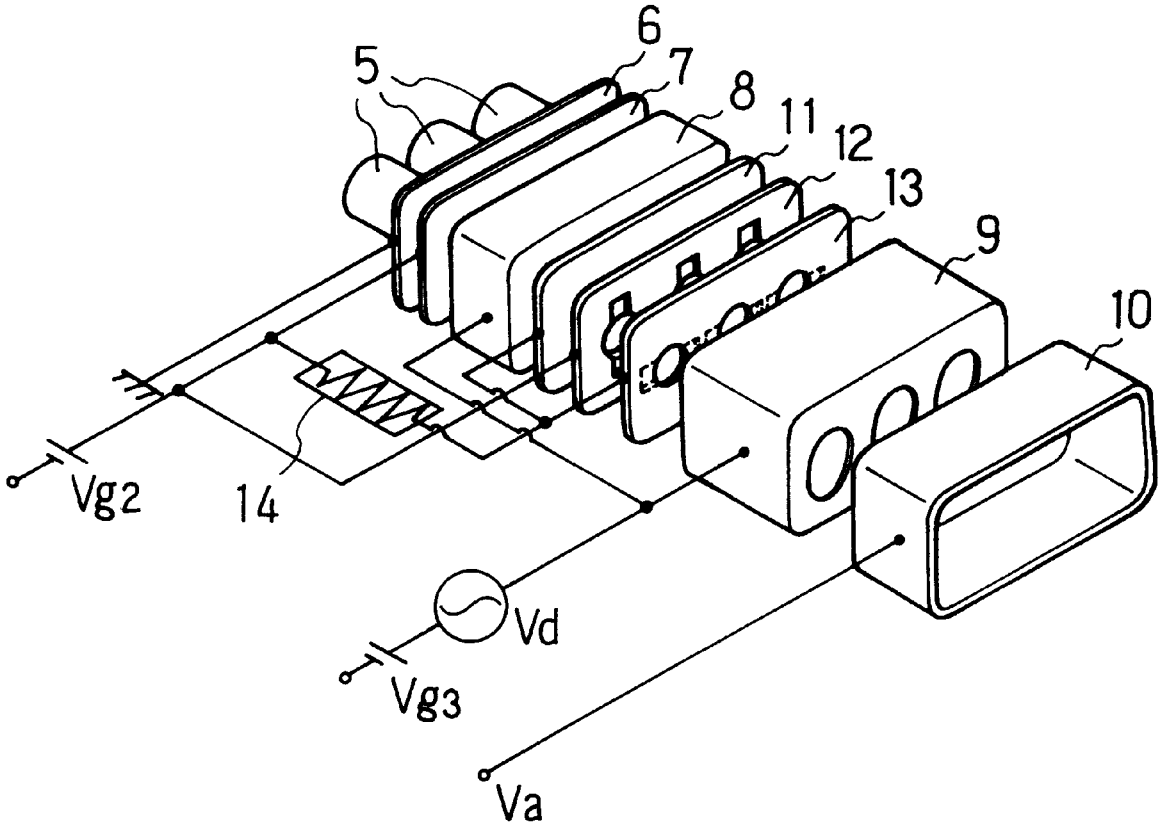
FIG. 2 is a perspective view showing the portion of the electron gun of the color picture tube apparatus in the first embodiment of this invention.

FIG. 2 is a perspective view showing the portion of the electron gun of the color picture tube apparatus in the first embodiment of this invention. As shown in FIG. 2, the electron gun comprises three cathodes 5 which are in-line arranged horizontally, a control lattice electrode 6, an accelerating electrode 7, a first focusing electrode 8, a second focusing electrode 9 and a final accelerating electrode 10.

Auxliary electrodes 11, 12 and 13 are provided between the first focusing electrode 8 and the second focusing electrode 9. Circular electron beam through holes are provided at the end surface of control lattice electrode 6, accelerating electrode 7, first focusing electrode 8, auxiliary electrodes 11, 12, 13 and the end surface of the second focusing electrode 9 facing the auxliary electrodes 13. According to the above-mentioned construction, a focusing lens generating means is formed between the first focusing electrode 8 and the auxiliary electrode 11.

A vertically oblong electron beam through hole is provided at the end surface of the second focusing electrode 9 facing the final accelerating electrode 10 and provided at the end surface of the final accelerating electrode 10 facing the second focusing electrode 9. A nonaxisymmetric electrostatic lens generating means, which has a focusing function in the horizontal direction and a divergence function in the vertical direction, is formed between the auxiliary electrodes 12 and 13. More concretely, a rectangular and vertically oblong electron beam through hole is provided at the end surface of the auxiliary electrode 12 facing the auxiliary electrode 13. Further, a rectangular and horizontally oblong electron beam through hole is provided at the end surface of the auxiliary electrode 13 facing the auxiliary electrode 12.

The auxiliary electrode 12 is connected electrically with the accelerating electrode 7. The auxiliary electrodes 11 and 13 are connected electrically with the accelerating electrode 7 via resistance.

Figure 3:
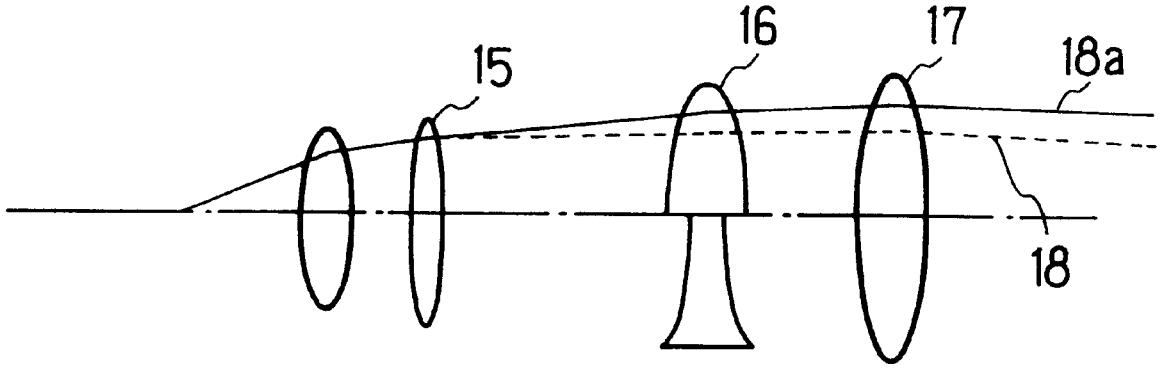
FIG. 3 is a figure showing an example of the lens in the first embodiment of this invention.

FIG. 3 is a figure showing an example of lens in the first embodiment of this invention. The upper side of FIG. 3 shows the horizontal direction and the lower side of that shows the vertical direction. An electron beam trajectory 18 shows the electron beam trajectory, which is not deflected, at the center of the screen. An electron beam trajectory 18*a* shows the electron beam trajectory, which is deflected, at the periphery of the screen. A quadropole lens 16 which has a focusing function in the horizontal direction and a divergence function in the vertical direction is generated by the nonaxisymmetric electrostatic lens generating means. An additional focusing lens 15 is generated by the focusing lens generating means.

When the compound voltage, in which the dynamic voltage $V_d$ which is synchronized with the deflection of the electron beam and is superimposed on the focusing voltage $V_{g3}$, is applied to the second focusing electrode 9, the dynamic voltage $V_d$ is applied to the first focusing electrode 8 which is connected electrically with the second focusing electrode 9. Further, the dynamic voltage is induced at the end surface of the auxiliary electrode 11 facing the first focusing electrode 8, and at the end surface of the auxliary electrode 13 facing the second focusing electrode 9. Consequently, a potential difference between the auxiliary electrodes 11, 12 and 13 is generated. As a result, as shown in the lens model in FIG. 3, a quadropole lens 16 is generated. Further, the potential at the second focusing electrode 9 is increased, the potential difference between the second focusing electrode 9 and the final accelerating electrode 10 becomes small, and consequently the focusing function of the main lens 17 generated between the second focusing electrode 9 and the final accelerating electrode 10 is weakened.

In order to induce the dynamic voltage $V_d$ at the auxiliary electrodes 11 and 13, it is preferable that the relation $R>1/(2\pi fC)$ is satisfied, wherein R represents the value of the resistance 14, C represents the capacitance of the auxiliary electrodes 11, 12 and 13, f represents the deflection frequency and $1/(2\pi fC)$ represents the impedance caused by the capacitance.

This is because when the value of resistance R is larger than the impedance caused by the capacitance C, the dynamic voltage is induced at the auxiliary electrodes 11 and 13.

It was confirmed that when the compound voltage, in which the dynamic voltage Vd=500V, which is synchronized with the deflection of electron beam and is superimposed on the focusing voltage, $V_{g3}$=7 kV, is applied to the second focusing electrode 9, the compound voltage, in which the dynamic voltage signal (250V) is superimposed on the accelerating voltage, $V_{g3}$=500V, was induced wherein R=1 MΩ, C=6 pF and f=64 kHz.

Figure 11:
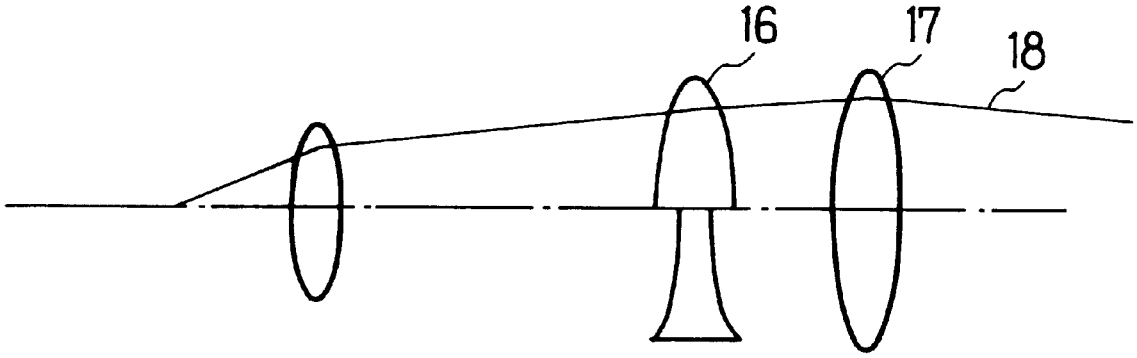
FIG. 11 (PRIOR ART)
FIG. 11 is a figure showing an example of lens of the conventional color picture tube apparatus.
Figure 12:
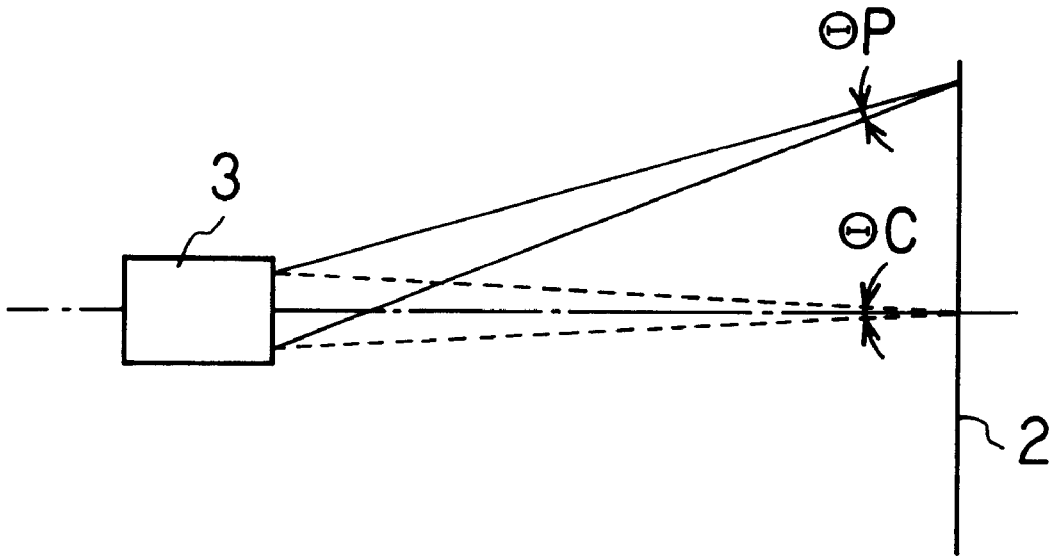
FIG. 12 (PRIOR ART)
FIG. 12 is a figure showing an electron beam trajectory from the electron gun to the screen of the conventional color picture tube apparatus.

In general, when the potential difference is the same, the electrode that has the lower potential can obtain the stronger lens function. Consequently, as above-mentioned, a quadrupole lens generated by the accelerating potential which is applied to the accelerating electrode has a stronger lens function in comparison with the conventional quadrupole lens generated by the focus potential as shown in FIG. 11. As a result, the compensating effect of astigmatism of the electron beam caused by the deflection magnetic field becomes stronger.

Both of the potential of the first focusing electrode 8 and the auxiliary electrode 11 are changed dynamically, however, the change of potential at the side of lower voltage has a stronger effect on the focusing function of the lens. Consequently, the focusing function of the additional focusing lens 15 is synchronized with the deflection of the electron beam and becomes weakened.

As the effect that is caused by weakening the focusing function of the main lens 17 is added to the effect, that is caused by weakening the focusing function of the additional focusing lens 15, the compensating effect of the defocus of electron beam caused by deflection magnetic field becomes strong significantly.

As above-mentioned, the compensating effects of the astigmatism of the electron beam caused by the deflection magnetic field and defocus of the electron beam become stronger. Consequently, the dynamic voltage of the color picture tube apparatus of this invention can be reduced dynamically in comparison with that of the conventional color picture tube apparatus.

Figure 4:
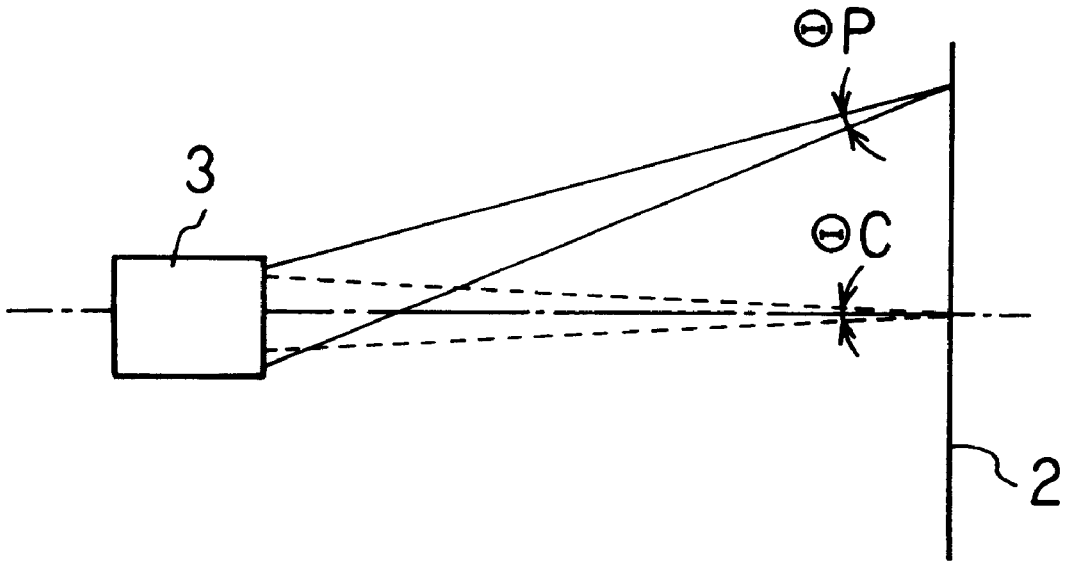
FIG. 4 is a figure showing an electron beam trajectory from the electron gun to the screen in the embodiments of this invention.

The increase of the length of the diameter of the spot at the periphery of the screen can be prevented. That is, as above-mentioned, the focusing function of the additional focusing lens 15 is synchronized with the deflection of the electron beam and is weakened, and as a result, the electron beam trajectory is expanded. As shown in FIG. 4, Θp, the angle of incidence of the electron beam at the periphery of the phosphor screen surface 2 can be increased. Therefore Θc, the angle of incidence of the electron beam at the center of the phosphor screen surface and Θp , that at the periphery of the screen can be equalized substantially. Consequently, the magnification of the lens at the center of the screen and the periphery of the screen can be equalized substantially and the increase of the diameter of the spot at the periphery of the screen can be prevented.

(A second embodiment)

Figure 5:
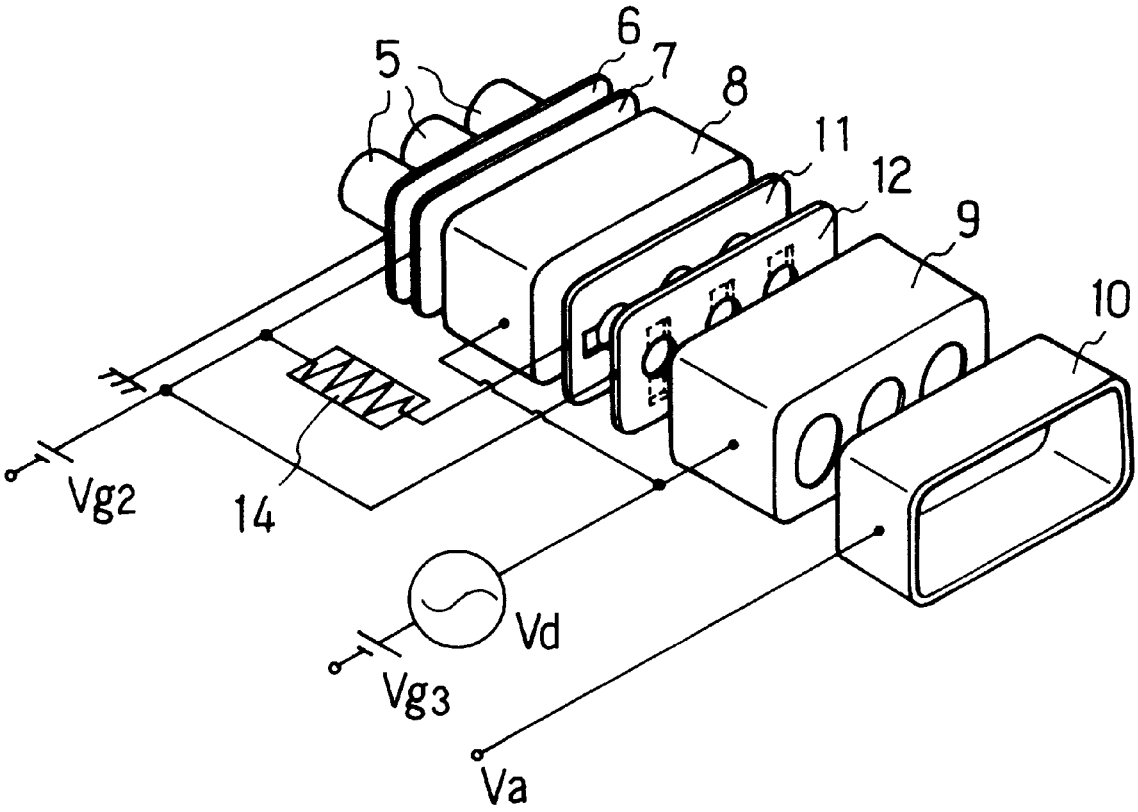
FIG. 5 is a perspective view showing the portion of the electron gun of the color picture tube apparatus in the second embodiment of this invention.

FIG. 5 is a perspective view showing the portion of the electron gun of the color picture tube apparatus in the second embodiment of this invention. As shown in FIG. 5, in the electron gun, circular beam through holes are provided at the end surface of control lattice electrode 6, accelerating electrode 7, first focusing electrode 8, auxiliary electrodes 11 and 12, and the end surface of the second focusing electrode 9 facing the auxiliary electrode 12. According to this construction, the focusing lens is generated between the first focusing electrode 8 and the auxiliary electrode 11.

Vertically oblong electron beam through holes are provided at the end surface of the second focusing electrode 9 facing the final accelerating electrode 10 and at the end surface of the final accelerating electrode 10 facing the second focusing electrode 9. A nonaxisymmetric electrostatic lens generating means having a focusing function in the horizontal direction and a divergence function in the vertical direction is generated between the auxiliary electrodes 11 and 12. More concretely, a rectangular and horizontally oblong electron beam through hole is provided at the end surface of the auxiliary electrode 11 facing the auxiliary electrode 12. Further, a rectangular and vertically oblong electron beam through hole is provided at the end surface of the auxiliary electrode 12 facing the auxiliary electrode 11.

Though the color picture tube apparatus in the first embodiment has three auxiliary electrodes, the color picture tube apparatus in the second embodiment has only two auxiliary electrodes. Consequently, the distance between the second focusing electrode 9 and the auxiliary electrode 12 is sufficiently wide. Consequently, the effective diameter of the electron lens generated between the electrodes can be increased, and the unnecessary aberration caused by the focusing of the electron beam at this position is not added. As a result, the shape of the electron beam spot becomes preferable and the resolution of the image display can be increased. The lens model and the effect obtained thereby in the second embodiment is the same as that in the first embodiment.

In the first and second embodiments, a bi-potential type of main lens in which the main lens is defined by the focusing electrode and the final accelerating electrode was used for purposes of explanation. However, the multi-stage type of main lens in which the main lens includes more than three electrodes may be used.

(A third embodiment)

Figure 6:
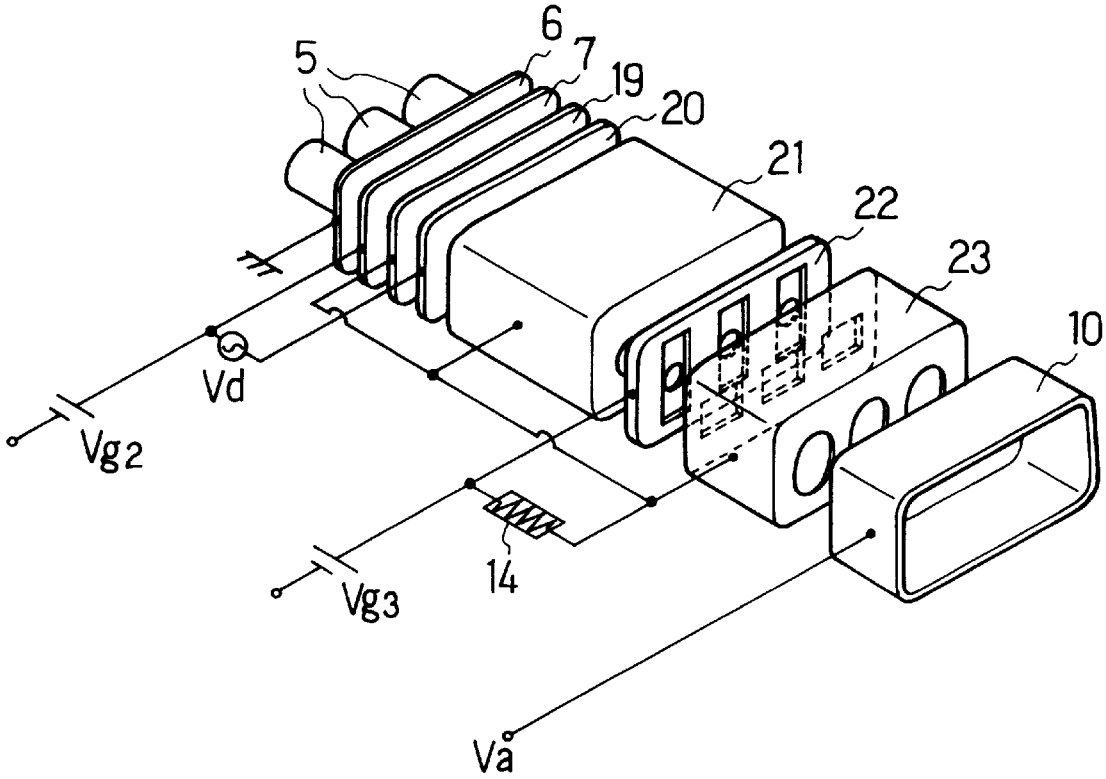
FIG. 6 is a perspective view showing the portion of the electron gun of the color picture tube apparatus in the third embodiment of this invention.

FIG. 6 is a perspective view showing the portion of the electron gun of the color picture tube apparatus in the third embodiment of this invention. As shown in FIG. 6, the electron gun comprises three cathodes 5 which are in-line arranged horizontally, a control lattice electrode 6, an accelerating electrode 7, a first focusing electrode 19, an auxiliary electrode 20, a second focusing electrode 21, a third focusing electrode 22, a fourth focusing electrode 23 and a final accelerating electrode 10.

Circular electron beam through holes are provided at the end surface of control lattice electrode 6, accelerating electrode 7, first focusing electrode 19, auxiliary electrode 20 and second focusing electrode 21. According to the above-mentioned constitution, uni-potential type of additional focusing lens generating means is generated between the first focusing electrode 19 and the second focusing electrode 21 provided at the both sides of the auxiliary electrode 20.

Rectangular and vertically oblong electron beam through holes are provided at the end surface of the fourth focusing electrode 23 facing the final accelerating electrode 10 and at the end surface of the final accelerating electrode 10 facing the fourth focusing electrode 23. A nonaxisymmetric electrostatic lens generating means which has a focusing function in the horizontal direction and a divergence function in the vertical direction is provided between the third focusing electrode 22 and the fourth focusing electrode 23.

More concretely, a circular electron beam through hole is provided at the end surface of the third focusing electrode 22 facing the second focusing electrode 21. A rectangular and vertically oblong electron beam through hole is provided a t the end surface of the third focusing electrode 22 facing the fourth focusing electrode 23. Further, a rectangular and horizontally oblong electron beam through hole is provided at the end surface of the fourth focusing electrode 23 facing the third focusing electrode 22.

The first focusing electrode 19, the second focusing electrode 21 and the fourth focusing electrode 23 are connected electrically. Further, the portion which is connected electrically is connected electrically with the third focusing electrode 22 via a resistance 14.

A predetermined accelerating voltage $V_{g2}$ is applied to the accelerating electrode 7 and a predetermined focusing voltage $V_{g3}$ is applied to the third focusing electrode 22 respectively.

Figure 7:
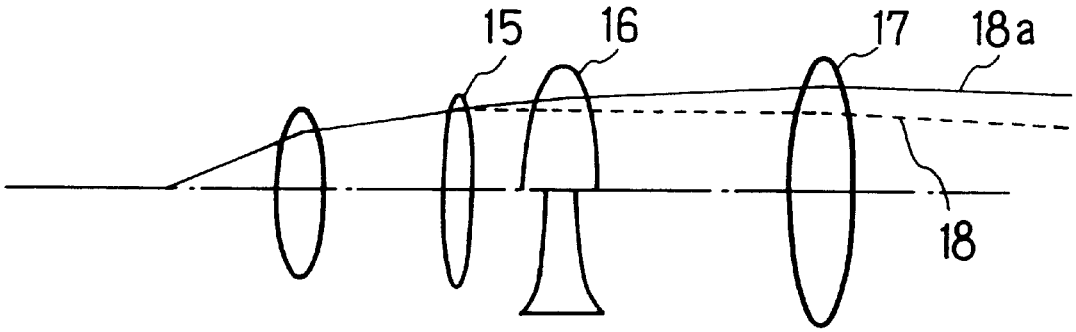
FIG. 7 is a figure showing an example of the lens in the third embodiment of this invention.

FIG. 7 is a figure showing an example of the lens in the third embodiment of this invention. The upper side of FIG. 7 shows the horizontal direction and the lower side shows the vertical direction. An electron beam trajectory 18 shows the electron beam trajectory, which is not deflected, at the center of the screen. An electron beam trajectory 18*a* shows the electron beam trajectory, which is deflected, at the periphery of the screen.

A quadropole lens 16 is generated by the e nonaxisymmetric electrostatic lens generating means. An additional focusing lens 15 is generated by the focusing lens generating means.

$C_2$ represents the capacitance between the electrodes at which the nonaxsymmetric electrostatic lens generating means is provided, $C_1$ represents the capacitance between the electrodes at which h the additional focusing lens generating means is provided, R represents the value of the resistance 14 and f represents the deflection frequency. When $C_1$ is sufficiently large for $C_2$, the relation $R>1/(2\pi fC_2)$ is satisfied, wherein $1/(2\pi fC_2)$ represents the impedance caused by capacitance $C_2$, the dynamic voltage is induced at the first focusing electrode 19 and the second focusing electrode 21 provided at the both sides of the auxiliary electrode 20 and the potential of the first, second and fourth focusing electrodes against the focusing voltage $V_{g3}$ is increased by applying the compound voltage, in which the dynamic voltage $V_d$ which is synchronized with the deflection of electron beam and is superimposed on the accelerating voltage $V_{g2}$, to the auxiliary electrode 20.

Consequently, the potential difference between the third focusing electrode 22 and the second focusing electrode 21, and between the third focusing electrode 22 and the fourth focusing electrode 23 is generated. As shown in FIG. 7, the nonaxisymmetric electrostatic lens generating means 16 is generated. Consequently, the focusing function of the additional focusing lens 15 is weakened and at the same time, the focusing function of the main lens 17 is also weakened.

As above-mentioned, the focusing function of the additional lens 15 is synchronized with the deflection of the electron beam and becomes weakened. Consequently, the electron beam trajectory is expanded. In the same way as the first embodiment explained referring to FIG. 4, Θp, the angle of incidence of the electron beam at the periphery of the screen can be increased. Therefore, Θp, the incidence of the electron beam at the periphery of the screen and Θc, that at the center of the screen can be equalized substantially. Consequently, the magnification of the lens at the center of the screen and the periphery of the screen can be equalized substantially and the increase of the diameter of the spot at the periphery of the screen can be prevented.

The nonaxisymmetric electrostatic lens 16 having a focusing function in the horizontal direction and has a divergence function in the vertical direction is generated and the focusing function of the main lens 17 is weakened. Consequently, the astigmatism of the electron beam caused by the deflection magnetic field and the defocus of the electron beam can be compensated. This point is the same as that of the conventional color picture tube apparatus. Unlike the conventional color picture tube apparatus, in the color picture tube apparatus in the third embodiment of this invention, not a focusing voltage which is a high voltage, but an accelerating voltage which is a low voltage is superimposed on the dynamic voltage. Consequently, the load of the circuit and the cost can be reduced.

Further, the number of focus pins can be decreased from two to one, and consequently the cost can be reduced. Further, the focusing function of the main lens 17 is weakened at the same time the focusing function of the additional focusing lens 15 is weakened. Consequently, the sensitivity of the compensation of the defocus of electron beam caused by the deflection electron beam becomes strong, therefore the dynamic voltage can be decreased and the load of the circuit and the cost can be further reduced.

In the third embodiment of this invention, the nonaxisymmetric electrostatic lens means is provided between the third focusing electrode 22 and the fourth focusing electrode 23. However, the nonaxisymmetric electrostatic lens means may be provided between the second focusing electrode 21 and the third focusing electrode 22.

(A fourth embodiment)

Figure 8:
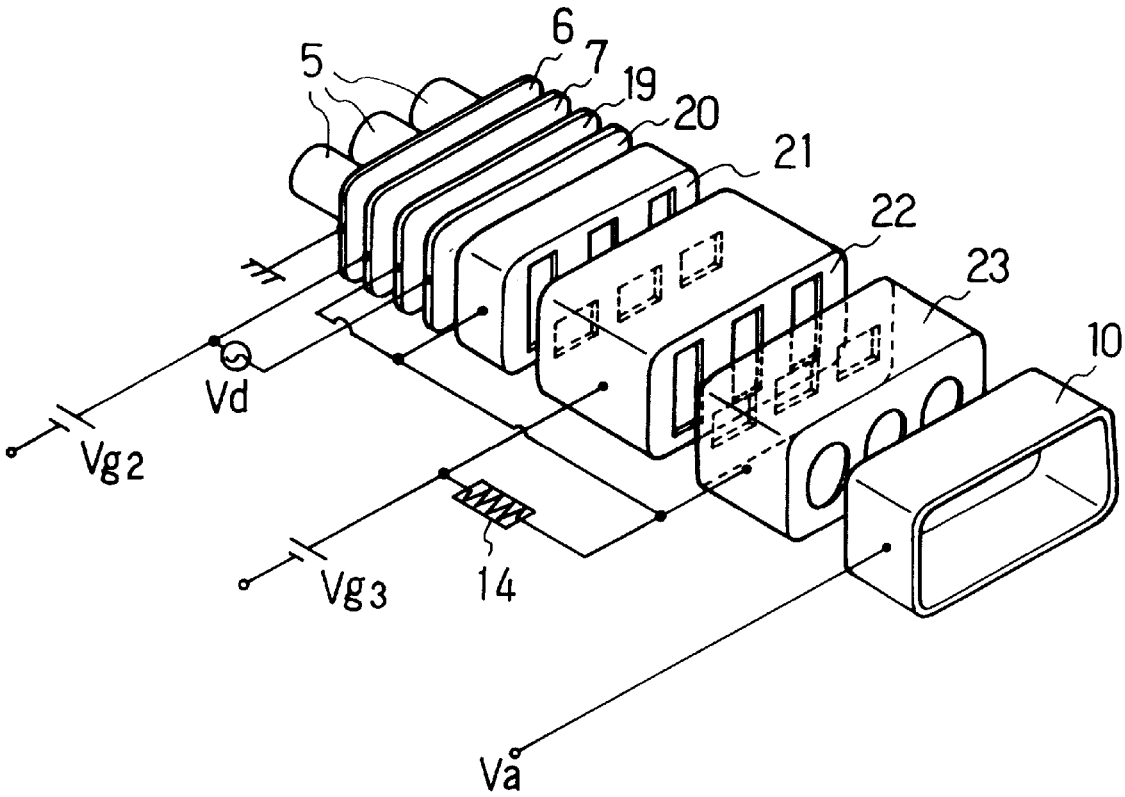
FIG. 8 is a perspective view showing the portion of the electron gun of the color picture tube apparatus in the fourth embodiment of this invention.

FIG. 8 is a perspective view showing the portion of the electron gun of the color picture tube apparatus in the fourth embodiment of this invention. As shown in FIG. 8, the electron gun comprises three cathodes 5 which are in-line arranged horizontally, a control lattice electrode 6, an accelerating electrode 7, a first focusing electrode 19, an auxiliary electrode 20, a second focusing electrode 21, a third focusing electrode 22, a fourth focusing electrode 23 and a final accelerating electrode 10.

Circular electron beam through holes are provided at the end surface of control lattice electrode 6, accelerating electrode 7, first focusing electrode 19, auxiliary electrode 20 and at the end surface of the second focusing electrode 21 facing the auxiliary electrode 20. Vertically oblong electron beam through holes are provided at the end surface of the fourth focusing electrode 23 facing the final accelerating electrode 10 and at the end surface of the final accelerating electrode 10 facing the fourth focusing electrode 23.

A nonaxisymmetric electrostatic lens generating means is provided between the second focusing electrode 21 and the third focusing electrode 22 and between the third focusing electrode 22 and the fourth focusing electrode 23.

More concretely, rectangular and vertically oblong electron beam through holes are provided at the end surface of the second focusing electrode 21 facing the third focusing electrode 22 and at the end surface of the third focusing electrode 22 facing the fourth focusing electrode 23. Further, rectangular and horizontally oblong electron beam through holes are provided at the end surface of the third focusing electrode 22 facing the second focusing electrode 21 and at the end surface of the fourth focusing electrode 23 facing the third focusing electrode 22.

Figure 9:
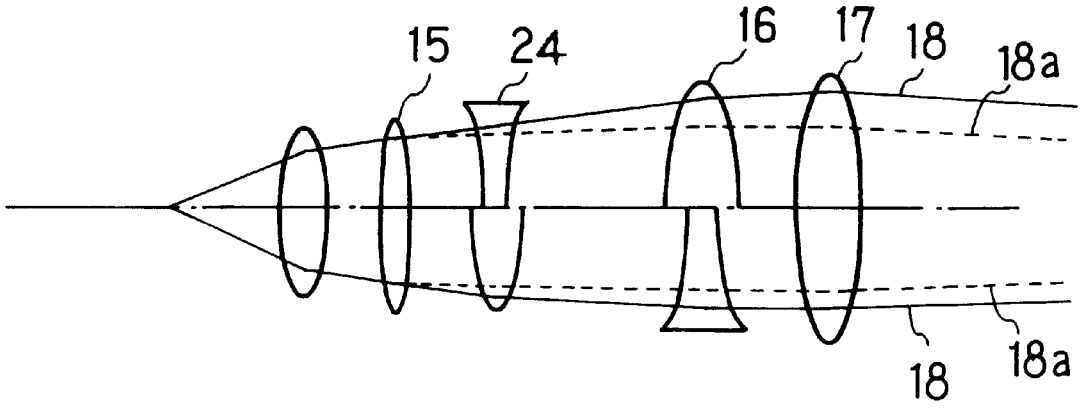
FIG. 9 is a figure showing an example of lens in the fourth embodiment of this invention.
Figure 10:
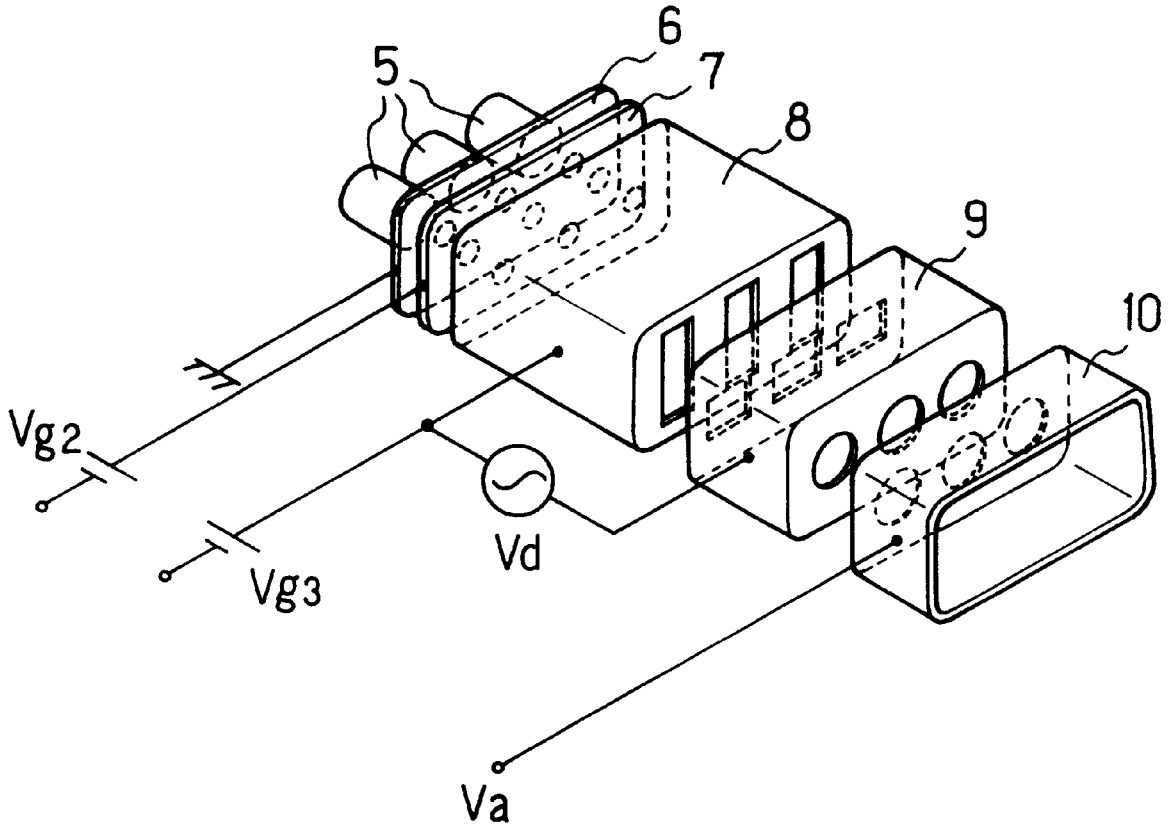
FIG. 10 (PRIOR ART)
FIG. 10 is a perspective view showing the portion of the conventional electron gun of the color picture tube.

FIG. 9 is a figure showing an example of the lens in the fourth embodiment of this invention. The upper side of FIG. 9 shows the horizontal direction and the lower side of that shows the vertical direction. An electron beam trajectory 18 shows the electron beam trajectory, which is not deflected, at the center of the screen. An electron beam trajectory 18a shows the electron beam trajectory, which is deflected, at the periphery of the screen.

In the fourth embodiment, as shown in the lens model in FIG. 9, a quadrupole lens 24 is generated between the second focusing electrode 21 and the third focusing electrode 22 by the nonaxisymmetric electrostatic lens generating means, and a quadrupole lens 16 is generated between the third focusing electrode 22 and the fourth focusing electrode 23 by the nonaxisymmetric electrostatic lens generating means. The quadrupole lens 16 has a focusing function in the horizontal direction and a divergence function in the vertical direction. The quadrupole lens 24 has a divergence function in the horizontal direction and has a focusing function in the vertical direction. That is, the quadrupole lens 16 and the quadrupole lens 24 have opposite functions in the horizontal direction and the vertical direction respectively.

The angle of incidence of electron beam both in the horizontal direction and the vertical direction can be controlled by adding the quadrupole lens 24 in addition to the quadrupole lens 16. Consequently, the shape of the spot at the periphery of the screen can be made the same as that at the center of the screen, that is, a circle.

In the above embodiments, it was explained that the shape of the electron beam through hole provided at the portion except for the portion where the nonaxisymmetric electrostatic lens is provided was a circle for convenience's sake. However, it is not limited thereto. It is well-known that various shapes of holes for forming the axisymmetric electrostatic lens is provided. In some cases, the hole for forming the nonaxisymmetric electrostatic lens is provided.

In the embodiments of this invention, only the means that the rectangular beam through hole is combined as the nonaxisymmetric electrostatic lens was mentioned. However, it is not limited thereto. It is well-known that the same effect can be obtained by the ordinary means for forming the nonaxisymmetric electrostatic lens, such as providing an oval-shaped hole or providing a protrusion in the vicinity of the electron beam through hole.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color picture tube apparatus comprising:

three cathodes which are in-line arranged in the horizontal direction;

an accelerating electrode;

a plurality of focusing electrodes;

an auxiliary electrode provided between said plurality of focusing electrodes;

wherein a nonaxisymmetric electrostatic lens is generated between a pair of adjoining electrodes;

a focusing lens is generated between a pair of adjoining electrodes; and a dynamic voltage which is synchronized with the deflection of electron beam is applied to one of said electrodes at which said focusing lens is generated and said dynamic voltage is induced at the other electrode at which said focusing lens is generated and said dynamic voltage is induced at one of said electrodes at which said nonaxisymmetric electrostatic lens is generated.

2. The color picture tube apparatus according to claim 1, wherein said plurality of focusing electrodes are first and second focusing electrodes, a plurality of auxiliary electrodes are provided, said plurality of auxiliary electrodes are provided between said first and second focusing electrodes, said nonaxisymmetric electrostatic lens is generated between two of said a plurality of auxiliary electrodes, said focusing lens generating means is provided between said first focusing electrode and one of said auxliary electrodes, one of said auxiliary electrodes is connected electrically with said accelerating electrode, the remainder of the plurality of auxiliary electrodes are connected electrically with said accelerating electrode via resistance and a dynamic voltage which is synchronized with the deflection of electron beam is applied to said first and second focusing electrodes.

3. The color picture tube apparatus according to claim 2, wherein said nonaxisymmetric electrostatic lens is a quadrupole lens having a focusing function in the horizontal direction and a divergence function in the vertical direction.

4. The color picture tube apparatus according to claim 3, wherein said quadrupole lens is generated by the accelerating potential.

5. The color picture tube apparatus according to claim 2, wherein the relation $R>1/(2\pi fC)$ is satisfied, wherein R represents the value of the resistance, C represents the capacitance between the auxiliary electrodes by which said nonaxisymmetric electrostatic lens is, and f represents the deflection frequency.

6. The color picture tube apparatus according to claim 2, wherein a compound voltage, in which said dynamic voltage is superimposed on a focusing voltage, is applied.

7. The color picture tube apparatus according to claim 2, wherein the number of said auxiliary electrodes is three, said nonaxisymmetric electrostatic lens is generated between the auxiliary electrode facing said second focusing electrode and the middle-positioned auxiliary electrode, said focusing lens is generated between said first focusing electrode and said auxiliary electrode facing said first focusing electrode.

8. The color picture tube apparatus according to claim 7, wherein the nonaxisymmetric electrostatic lens is generated by the vertically oblong electron beam through holes provided at an end surface of said middle-positioned auxiliary electrode facing said second focusing electrode and the horizontally oblong electron beam through holes provided at an end surface of the auxiliary electrode at the side of said second focusing electrode facing said middle-positioned auxiliary electrode.

9. The color picture tube apparatus according to claim 2, wherein the number of said auxiliary electrodes is two, said nonaxisymmetric electrostatic lens is generated between said two auxiliary electrodes, and said focusing lens is generated between said first focusing electrode and the auxiliary electrode facing said first focusing electrode.

10. The color picture tube apparatus according to claim 9, wherein said nonaxisymmetric electrostatic lens is generated by horizontally oblong electron beam through holes provided at an end surface of said auxiliary electrode at the side of said first focusing electrode facing said second focusing electrode and vertically oblong electron beam through holes provided at an end surface of said auxiliary electrode at the side of said second focusing electrode facing said first focusing electrode.

11. The color picture tube apparatus according to claim 1, wherein said plurality of focusing electrodes are a first, second, third and fourth focusing electrodes which are arranged from the side of said cathodes in the direction of the electron beam travel, a plurality of auxiliary electrodes are provided between said first and second focusing electrodes, said nonaxisymmetric electrostatic lens is generated at least one position, between said second and third focusing electrodes and between said third and fourth focusing electrodes, said focusing lens is generated between said first and second focusing electrodes, said first, second and fourth focusing electrodes are connected electrically, said third focusing electrode is connected electrically with said fourth focusing electrode via resistance, an accelerating voltage is applied to said accelerating electrode, a focus voltage is applied to said third focusing electrode, and a compound voltage, in which a dynamic voltage which is synchronized with the deflection of electron beam and is superimposed on said accelerating voltage, is applied to said auxiliary electrode.

12. The color picture tube apparatus according to claim 11, wherein the nonaxisymmetric electrostatic lens is generated between said third and fourth focusing electrodes and said nonaxisymmetric electrostatic lens has a focusing function in the horizontal direction and a divergence function in the vertical direction.

13. The color picture tube apparatus according to claim 12, wherein said nonaxisymmetric electrostatic lens is generated by electron beam through holes provided at an end surface of the third focusing electrode facing the second focusing electrode, vertically oblong electron beam through holes provided at an end surface of the third focusing electrode facing the fourth focusing electrode and the horizontally oblong electron beam through holes provided at an end surface of the fourth focusing electrode facing the third focusing electrode.

14. The color picture tube apparatus according to claim 11, wherein the nonaxisymmetric electrostatic lens is generated between said second and third focusing electrodes, and between said third and fourth focusing electrodes and said nonaxisymmetric electrostatic lens generated between said second and third focusing electrodes has a divergence function in the horizontal direction and a focusing function in the vertical direction and said nonaxisymmetric electrostatic lens generated between said third and fourth focusing electrode has a focusing function in the horizontal direction and a divergence function in the vertical direction.

15. The color picture tube apparatus according to claim 14, wherein said nonaxisymmetric electrostatic lens is generated by vertically oblong electron beam through holes provided at an end surface of said second focusing electrode facing said third focusing electrode and at an end surface of said third focusing electrode facing said fourth focusing electrode, and horizontally oblong electron beam through holes provided at an end surface of said third focusing electrode facing said second focusing electrode and that provided at the end surface of said fourth focusing electrode facing said third focusing electrode.

16. The color picture tube apparatus according to claim 11, wherein the relation $R>1/(2\pi fC)$ is satisfied, wherein R represents the value of said resistance, C represents the capacitance between the electrodes by which said nonaxisymmetric electrostatic lens is generated, and f represents the deflection frequency.

* * * * *